US005143430A

United States Patent [19]

Craven et al.

[11] Patent Number: 5,143,430

[45] Date of Patent: Sep. 1, 1992

[54] INNER DOOR LATCH

[75] Inventors: Christopher R. Craven; Richard A. Pollock, both of Fresno, Calif.

[73] Assignee: The Vendo Company, Fresno, Calif.

[21] Appl. No.: 578,915

[22] Filed: Sep. 6, 1990

[51] Int. Cl.[5] ..... A47B 48/02

[52] U.S. Cl. ..... 312/291; 49/67

[58] Field of Search ..... 312/291, 329; 49/67

[56] References Cited

U.S. PATENT DOCUMENTS

| | | | |
|---|---|---|---|
| 2,129,923 | 9/1938 | Frankel | 312/291 X |
| 2,233,699 | 3/1941 | Gorrell | 312/291 X |
| 3,287,079 | 11/1966 | Courson | 312/291 |
| 4,051,858 | 10/1977 | Mele | 312/291 X |
| 4,813,753 | 3/1989 | Relyea | 312/291 |

*Primary Examiner*—Joseph Falk

*Attorney, Agent, or Firm*—Robbins, Dalgarn, Berliner & Carson

[57] ABSTRACT

A latching mechanism is disclosed for application in vending machines, or the like. In a preferred embodiment the latching mechanism is of one-piece construction. The latching mechanism comprises a ramp mounted to an outer door of the vending machine and configured such that an inner door of the vending machine remains latched to the outer door when it is pulled away from a dispenser housing to access the refrigerated compartment therein. The ramp preferably comprises a ridge on a horizontal surface thereof. When the inner door is urged against the outer door, it passes over the ridge and comes to rest on the ramp. The ridge deters the inner door from sliding off the ramp and becoming detached from the outer door. An appropriate amount of force applied to separate the two doors causes the inner door to roll over the ridge and swing away from the outer door.

12 Claims, 2 Drawing Sheets

INNER DOOR LATCH

FIELD OF THE INVENTION

The present invention relates generally to the field of vending machines, or the like. More specifically, the present invention relates to a latching mechanism for use in vending machines and other similar applications.

BACKGROUND OF THE INVENTION

Vending machines, or the like, typically comprise a cabinet-like housing which has a refrigerated compartment therein for storing a selection of food or drink items. Upon receiving a designated amount of money, the vending machine dispenses a desired food or drink item to a user. The cabinet-like housing has an outer door with a control panel and an inner door which seals the refrigerated compartment. The inner door is commonly a steel panel filled with insulation such as foam, and the like. The lighting and control panel elements are located between the inner and outer doors.

As customary, the refrigerated compartment must be frequently accessed to replenish the drink and food items. On occasion, it is also necessary to access the lighting and control panel elements for servicing and maintenance purposes. For this reason, since the refrigerated compartment is more frequently accessed, currently available vending machines feature an arrangement whereby the inner door remains latched to the outer door, unless the two are separated to provide access to the control panel elements between the two doors. This arrangement prevents the inner door from jamming against the housing wall when the outer door is opened and provides direct and easy access to the refrigerated compartment.

Some existing vending machines utilize a latching mechanism comprising a plurality of parts. One such prior latching mechanism provides a ramp mounted on the outer door to support the inner door at its outer edge and a spring loaded latch mounted to the front surface of the inner door. Typically, prior ramps terminate in a blunt edge. A roller strike is mounted to the outer door, to which the spring-loaded latch connects when the inner door is closed.

Since the inner door is filled with insulation, it has a natural tendency to sag. Thus, to ensure that the inner door is properly latched to the outer door it must either be forcefully slammed against the outer door or carefully lifted over the blunt edge. The former is more frequently adopted which results in damaged components.

The tendency of the inner door to sag requires frequent adjustment of the ramp, latch and strike. The ramp, latch, and strike, are provided with slotted mounting holes to facilitate such adjustment. Although such prior latching devices have served the purpose, it is time-consuming to individually adjust each of the plurality of parts which requires additional labor and expense during assembly and routine maintenance. Further, extra parts contribute to increased manufacturing expenses.

A need thus exists for a simple yet effective latching mechanism of one-piece construction which eliminates additional and unnecessary parts and reduces assembly time, labor and expense.

SUMMARY OF THE INVENTION

Briefly, the present invention is directed to a latching mechanism for use in a vending machine, or the like. The latching mechanism, in a preferred embodiment is of one-piece construction and eliminates a plurality of parts utilized by prior devices. Because the present latching mechanism is preferably a single component of simple construction, it saves time, labor and expense during assembly and routine maintenance.

In accordance with one aspect of the invention, the latching mechanism comprises a one-piece ramp mounted to an outer door of the vending machine and configured to keep an inner door latched to the outer door. The ramp prevents the inner door from swinging away from the outer door and jamming against a housing wall of the vending machine dispenser when the outer door is opened.

In another aspect of the invention, the ramp comprises a portion thereof on a horizontal surface of the ramp, formed integrally and configured such that when the inner door is urged against the outer door, it passes over the portion and comes to rest on the ramp.

In still another aspect of the invention, the ramp at its outer extremity has a gradually tapered portion which allows the inner door to be eased up the tapered portion.

In yet another aspect of the present invention, the portion of the ramp is preferably raised to form a ridge such that an appropriate amount of force applied to separate the two doors causes the inner door to roll over the ridge and swing away from the outer door.

These as well as other features of the invention will become apparent from the detailed description which follows, considered together with the appended drawings.

BRIEF DESCRIPTION OF THE DRAWINGS

A preferred and an alternative embodiment of the present invention are illustrated in and by the following drawings in which like reference numerals indicate like parts and in which.

DETAILED DESCRIPTION OF THE PREFERRED EMBODIMENT

Figure 1:
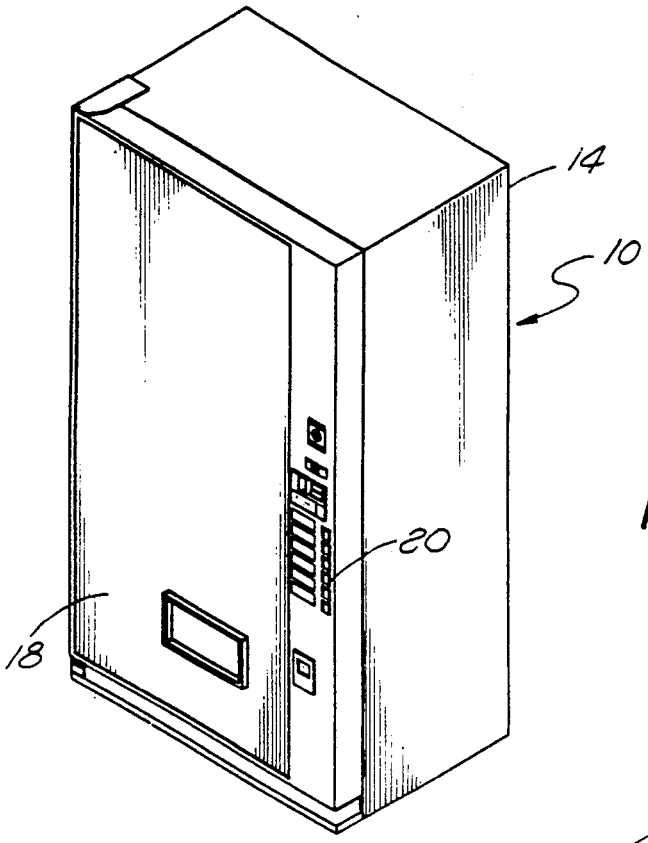
FIG. 1 is a perspective view of an exemplary vending machine.
Figure 2:
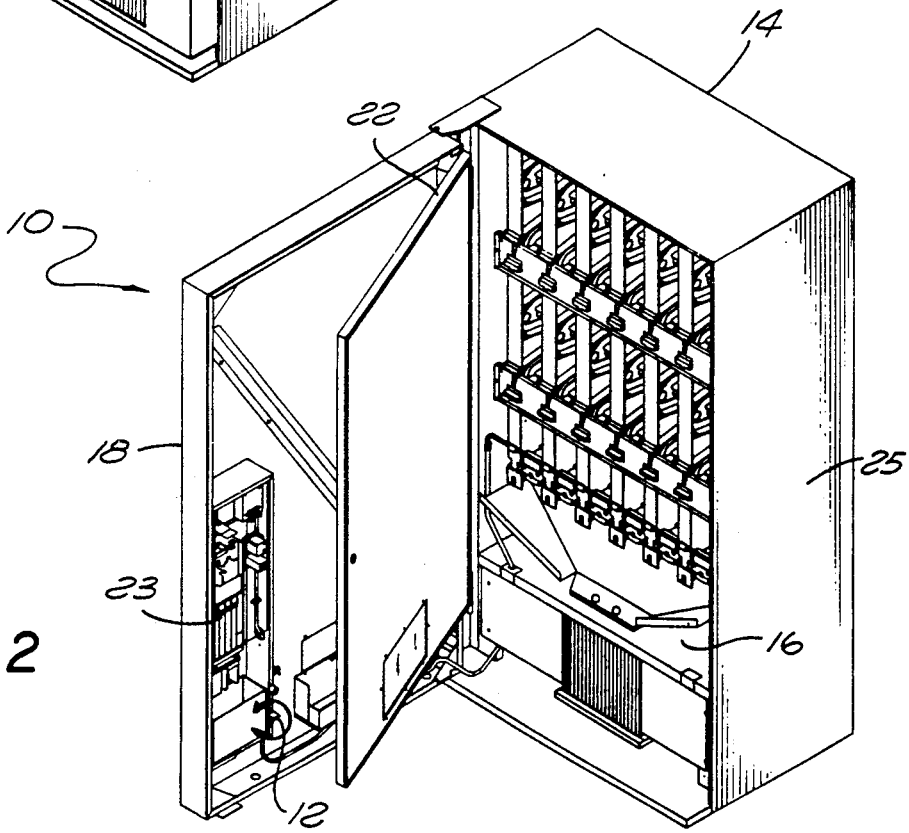
FIG. 2 is a perspective view illustrating an inner door and an outer door of the vending machine of FIG. 1, and a latching mechanism in accordance with the present invention.

FIGS. 1 and 2 illustrate generally a vending machine 10 which is shown for illustration purposes only and is exemplary of other similar applications which can utilize a latching mechanism 12 in accordance with the present invention. Commonly, a vending machine 10 comprises a dispenser having a cabinet-like housing 14 which has a refrigerated compartment 16 therein where selected food or drink items are stored. The vending machine 10 also comprises an outer door 18 having a control panel 20, and an inner door 22, which is hinged on the outer door 18 and serves to seal the refrigerated compartment 16. Lighting, control panel elements, and the like, indicated generally at 23 are housed between the outer and inner doors, 18 and 22, respectively.

The latching mechanism 12 is preferably of one-piece construction and advantageously latches the inner door 22 to the outer door 18 in order to prevent the inner door 22 from jamming against a housing wall 25 when the outer door 18 is opened. Because the latching mechanism is preferably constructed as a single unit, the manufacturing and maintenance costs of the vending machine 10 are substantially reduced since it requires less labor, parts and time, during assembly and routine maintenance. The unique configuration of the latching mechanism is described in detail below.

Figure 3:
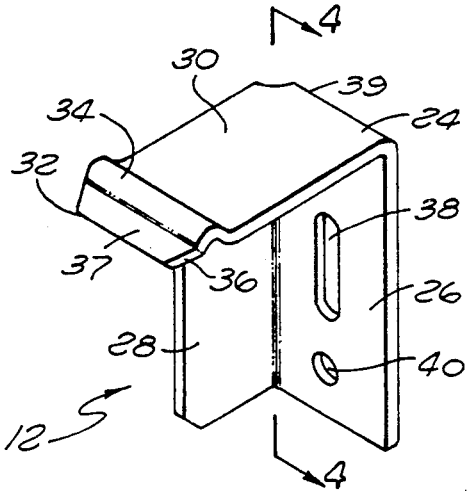
FIG. 3 is a side elevational view of a preferred embodiment of the inner door latching mechanism in accordance with the present invention.
Figure 4:
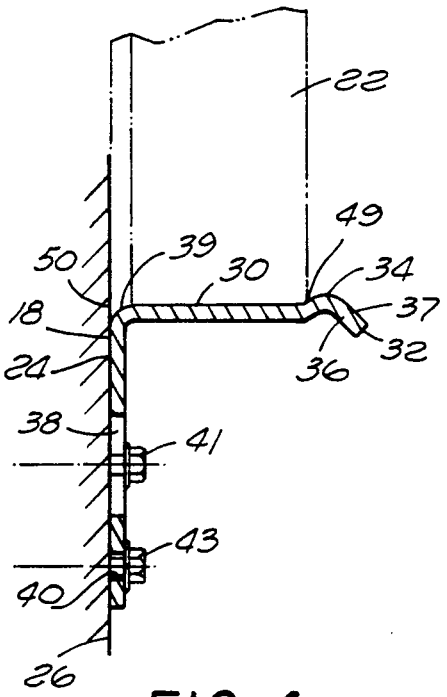
FIG. 4 is a cross sectional view taken along line 4—4 of FIG. 3.

Referring to FIGS. 3 and 4, the latching mechanism 12, comprises a ramp 24 which is mounted to the outer door 18 as best shown in FIG. 2. The ramp 24, in accordance with a preferred embodiment comprises two intersecting vertical walls, a rear wall 26 and a side wall 28. Each of the vertical walls, 26 and 28 are substantially rectangular in configuration and have a suitable thickness. The ramp 24 also comprises an upper horizontal wall 30 which extends substantially perpendicular to the rear and side walls 26 and 28.

The upper horizontal wall 30 proximate its peripheral extremity 32 has a portion 31 thereof preferably raised to form a ridge 34 which extends across the width of the upper horizontal wall 30. The portion 31 may alternatively be configured in any other way such as to form a depression, or the like, which in conjunction with at least one cooperating member secured to the inner door 22 would serve to effectively latch the inner door 22 to the outer door 18.

The upper horizontal wall 30, from the ridge 34 to its peripheral extremity 32 terminates in a sloped portion 36 along its side extremities. A portion of the upper horizontal wall 30 has a gradually tapered upper surface 37 which allows the inner door 22 to be easily guided up the tapered surface 37 and over the ridge 34 without any extra effort. The ridge 34 is sufficiently spaced from a junction 39 between the vertical wall 26 and upper horizontal wall 30 to enable the inner door 22 to be securely latched between the outer door 18 and the ridge 34. The inner door 22, when latched, is placed in intimate contact with the ridge 34, at one end 49, and the outer door 18 at another end 50, as best shown in FIG. 4.

Centrally disposed in the vertical wall 26 is an elongate opening 38 and a circular opening 40 disposed directly below the opening 38. Both the openings 38 and 40 receive fasteners 41 and 43 therethrough for mounting the ramp 24 to the outer door 18 as illustrated clearly in FIG. 4. The ramp 24 is preferably constructed from a suitable metal such as steel, preferably using a progressive die or other such suitable technique.

Figure 5:
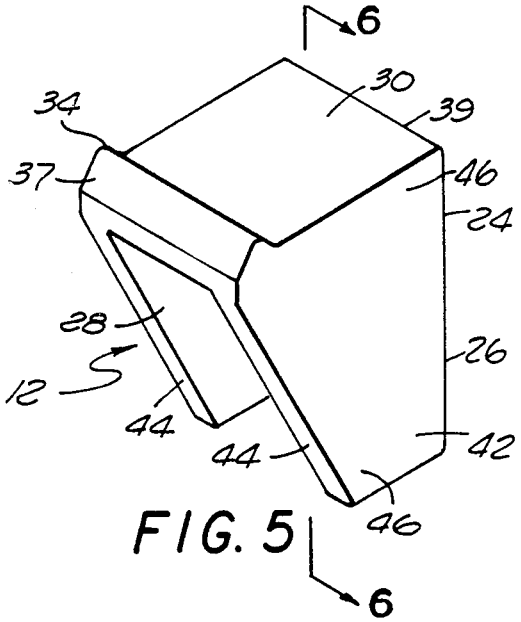
FIG. 5 is a side elevational view of an alternative embodiment of the inner door latching mechanism in accordance with the present invention.
Figure 6:
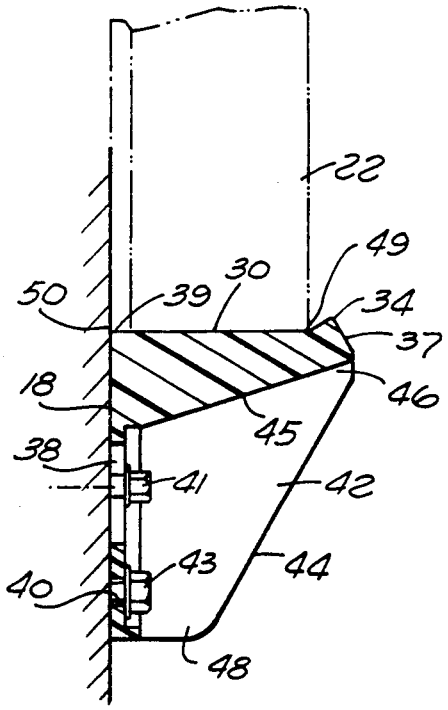
FIG. 6 is a cross sectional view taken along line 5—5 of FIG. 5.

Referring now to FIGS. 5 and 6, the ramp 24, in accordance with an alternative embodiment, comprises two intersecting walls, a rear wall 26 and a side wall 28 similar to the embodiment described above. The ramp 24 also comprises an upper horizontal wall 30, extending substantially perpendicular to the rear and side walls 26 and 28. The upper horizontal wall 30 has an inclined lower periphery 45, as best shown in FIG. 6. The ramp 24 comprises a second side wall 42 parallel to the side wall 28. Each of the side walls 28 and 42 has a sloped outer extremity 44. Each of the walls 28 and 42, decreases in width from an upper portion 46, adjoining the upper horizontal wall 30, to a lower portion 48. The ridge 34 integrally formed with the ramp 24 extends between both the side walls 28 and 42 and is sufficiently spaced from the junction 39 to allow the inner door 22 to be guided up the tapered portion 37 and securely latched between the outer wall 18 and the ridge 34. In the alternative embodiment the tapered portion 37 has a steeper slope.

In accordance with the alternative embodiment, the ramp 24 is preferably injection-molded in a multi-cavity die, using nylon 6/6 resin, or other such suitable plastic material.

Although the invention has been described in terms of a preferred embodiment thereof, other embodiments that are apparent to those of ordinary skill in the art are also within the scope of the invention. Accordingly, the scope of the invention is intended to be defined only by reference to the appended claims.

What is claimed is:

1. A vending machine, comprising:

a dispensing means having a refrigerated compartment therein;

an outer door attached to said dispensing means;

an inner door hinged to said outer door, said inner door for sealing said refrigerated compartment;

latching means mounted to said outer door, said latching means of one-piece construction and having a ridge integrally formed therewith, said ridge configured to enable said inner door when urged against said outer door from a first separated position to pass over said ridge to a second adjacent position, an appropriate amount of force applied to separate said inner and outer doors causing said inner door to roll over said ridge and swing away form said outer door to said first separated position.

2. A vending machine as defined in claim 1 wherein said ridge is formed on a horizontal surface of said latching means.

3. A vending machine as defined in claim 2, wherein said ridge extends substantially across the width of said horizontal surface of said latching means.

4. A vending machine as defined in claim 1, wherein said latching means comprises two intersecting walls and an upper horizontal wall perpendicular to said intersecting walls, said ridge being formed on said upper horizontal wall.

5. A vending machine as defined in claim 1, wherein said latching means comprises two parallel side walls, a rear wall and an upper horizontal wall, said a ridge extending across the width of said upper horizontal wall.

6. A vending machine as defined in claim 1, wherein said latching means is constructed from a suitable metal.

7. A vending machine as defined in claim 6, wherein said metal is steel.

8. A vending machine as defined in claim 1, wherein said latching means is formed from plastic.

9. A vending machine as defined in claim 8, wherein said latching means is formed from an engineering plastic.

10. A vending machine as defined in claim 8, wherein said plastic is nylon 6/6 resin.

11. A vending machine as defined in claim 1, wherein said latching means is injection-molded.

12. A vending machine as defined in claim 1, wherein said latching means is formed using a progressive die.

* * * * *